US010487597B2

(12) United States Patent
Stankovic

(10) Patent No.: US 10,487,597 B2
(45) Date of Patent: Nov. 26, 2019

(54) TUBULAR HANDLING TOOL

(71) Applicant: Weatherford Technology Holdings, LLC, Houston, TX (US)

(72) Inventor: Igor Stankovic, Gehrden (DE)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 828 days.

(21) Appl. No.: 14/561,295

(22) Filed: Dec. 5, 2014

(65) Prior Publication Data

US 2015/0159444 A1 Jun. 11, 2015

Related U.S. Application Data

(60) Provisional application No. 61/912,591, filed on Dec. 6, 2013.

(51) Int. Cl.

| | |
|---|---|
| ***E21B 19/07*** | (2006.01) |
| ***E21B 33/04*** | (2006.01) |
| ***E21B 21/02*** | (2006.01) |
| *F16L 1/20* | (2006.01) |

(52) U.S. Cl.

CPC ..... *E21B 19/07* (2013.01); *E21B 21/02* (2013.01); *E21B 33/0422* (2013.01); *F16L 1/207* (2013.01)

(58) Field of Classification Search

CPC ..... E21B 19/07; E21B 33/0422; E21B 21/02

See application file for complete search history.

(56) References Cited

U.S. PATENT DOCUMENTS

| | | | | |
|---|---|---|---|---|
| 1,693,478 A | | 11/1928 | Davis | |
| 2,031,337 A | | 2/1936 | Spalding | |
| 2,048,209 A | | 7/1936 | Young et al. | |
| 2,109,493 A | * | 3/1938 | Lundeen | E21B 19/07 188/67 |
| 2,563,851 A | | 8/1951 | Lundeen | |
| 4,126,336 A | | 11/1978 | Ortloff et al. | |
| 4,421,179 A | | 12/1983 | Boyadjieff | |
| 4,423,648 A | * | 1/1984 | Toelke | E21B 19/164 81/57.16 |
| 6,394,201 B1 | * | 5/2002 | Feigel, Jr. | E21B 10/00 166/75.14 |
| 8,141,923 B2 | | 3/2012 | Bouligny et al. | |

(Continued)

FOREIGN PATENT DOCUMENTS

| | | |
|---|---|---|
| GB | 403367 A | 12/1933 |
| GB | 634410 A | 3/1950 |

(Continued)

OTHER PUBLICATIONS

EPO Extended European Search Report dated Jul. 12, 2016, for European Patent Application No. 14196634.1.

(Continued)

*Primary Examiner* — David Carroll

(74) *Attorney, Agent, or Firm* — Patterson + Sheridan, LLP

(57) ABSTRACT

An elevator for use in handling a tubular includes a first body part coupled to a second body part and at least two slips coupled to each of the first and second body parts. One or more of the slips includes an engagement member for coupling with a mating member of the first body part or the second body part, wherein at least 25% of the engagement member is coupled with the mating member when the slip is in an open position.

20 Claims, 12 Drawing Sheets

(56) References Cited

U.S. PATENT DOCUMENTS

| | | | | |
|---|---|---|---|---|
| 2005/0046181 | A1 | 3/2005 | Falconer | |
| 2008/0174131 | A1* | 7/2008 | Bouligny | E21B 19/07 294/197 |
| 2009/0114403 | A1 | 5/2009 | Borst et al. | |
| 2009/0252589 | A1 | 10/2009 | Sonneveld et al. | |
| 2010/0319932 | A1* | 12/2010 | Angelle | B66C 1/12 166/380 |
| 2011/0232919 | A1 | 9/2011 | Snider et al. | |
| 2012/0326459 | A1 | 12/2012 | Angelle et al. | |

FOREIGN PATENT DOCUMENTS

| | | | |
|---|---|---|---|
| WO | 99/49177 | A1 | 9/1999 |
| WO | 2007/070805 | A2 | 6/2007 |
| WO | 2008088933 | A1 | 7/2008 |
| WO | 2009/109355 | A1 | 9/2009 |

OTHER PUBLICATIONS

Australian Examination Report dated Sep. 30, 2015, for Australian Patent Application No. 2014271348.
EPO Partial European Search Report dated Mar. 3, 2016, for EPO Patent Application No. 14196634.1.
Canadian Office Action dated Jan. 13, 2017, for Canadian Patent Application No. 2,873,527.
Canadian Office Action dated Dec. 30, 2015, for Canadian Patent Application No. 2,873,527.
Examination Report in related application AU 2017200036 dated Nov. 16, 2017.

* cited by examiner

TUBULAR HANDLING TOOL

CROSS-REFERENCE TO RELATED APPLICATIONS

This application claims benefit of U.S. provisional patent application Ser. No. 61/912,591, filed Dec. 6, 2013, which patent application is herein incorporated by reference in its entirety.

BACKGROUND OF THE INVENTION

1. Field of the Invention

Embodiments of the invention generally relate to apparatus and methods for handling tubulars. More particularly, embodiments of the invention relate to a tubular handling tool such as a single joint elevator.

2. Description of the Related Art

When drilling wells in the oil and gas industry using a drilling rig, the operation of hoisting tubulars onto the rig floor is commonly accomplished by using an elevator suspended within the derrick of the rig. Usually the elevator is sized and constructed to be suitable only for handling single tubular joints (i.e. not a string of joints connected together). Such an elevator is referred to as a "single joint elevator" or "SJE".

Single joint elevators are specifically adapted for securing and lifting tubulars having conventional connections. A conventional connection generally includes a collar configured to receive a tubular at each end of the collar. The collar forms a shoulder for engaging the single joint elevator. Typical single joint elevators include two hinged body halves that form a circle when closed. In use, the body halves of the elevator engage the shoulder formed by the collar connecting the tubulars. As such, conventional single joint elevator can only grip a tubular at the collar. Also, conventional single joint elevators cannot grip a tubular that does not have a shoulder, such as a flush joint tubular or a semi-flush tubular.

There is a need, therefore, for an elevator configured to handle tubulars without the need to support a collar.

SUMMARY OF THE INVENTION

The present invention generally relates to apparatus and methods for gripping tubulars. In one embodiment, a tubular handling tool for handling a tubular includes a first body part coupled to a second body part; and at least two slips coupled to each of the first and second body parts, wherein one or more of the slips includes an engagement member for coupling with a mating member of the first body part or the second body part, wherein at least 25% of the engagement member is coupled with the mating member when the slip is in an open position. Exemplary tubular handling tools include an elevator and a spider.

In another embodiment, a swivel includes an upper housing rotatably coupled to a lower housing; and a rotary union having a rotating body attached to the lower housing and a non-rotating body attached to the upper housing, wherein the swivel is configured to transfer load from the lower housing to the upper housing.

In another embodiment, a tubular handling tool for handling a tubular includes a first body part coupled to a second body part; and one or more slips coupled to each of the first and second body parts, wherein at least one slip includes an engagement member for coupling with a mating member of the first body part or the second body part, wherein at least 25% of the engagement member is coupled with the mating member when the at least one slip is in an open position. Exemplary tubular handling tools include an elevator and a spider.

In another embodiment, an elevator for use in handling a tubular includes a first body part coupled to a second body part; a movable gripping member that is movable relative to the first body part; and a passive gripping member coupled to at least one of the first body part and the second body part.

In another embodiment, a tubular handling tool for handling a tubular includes a first body part coupled to a second body part; and a slip coupled to each of the first and second body parts, wherein at least one slip includes an engagement member for coupling with a mating member of the first body part or the second body part, wherein the engagement member is coupled with at least 40 percent of the mating member when the at least one slip is in the open position.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 6A is a perspective view of the swivel. FIG. 6B is a cross-sectional view of the swivel. FIG. 6C shows the tubular extension coupled to the rotary union.

DETAILED DESCRIPTION

In one embodiment, a tubular handling tool includes a body and a plurality of slips coupled to the body. At least one of the slips includes an engagement member for coupling with a mating member of the body, wherein at least 25% of the engagement member is coupled with the mating member when the slip is in an open position. Exemplary tubular handling tools include an elevator and a spider.

Figure 1:
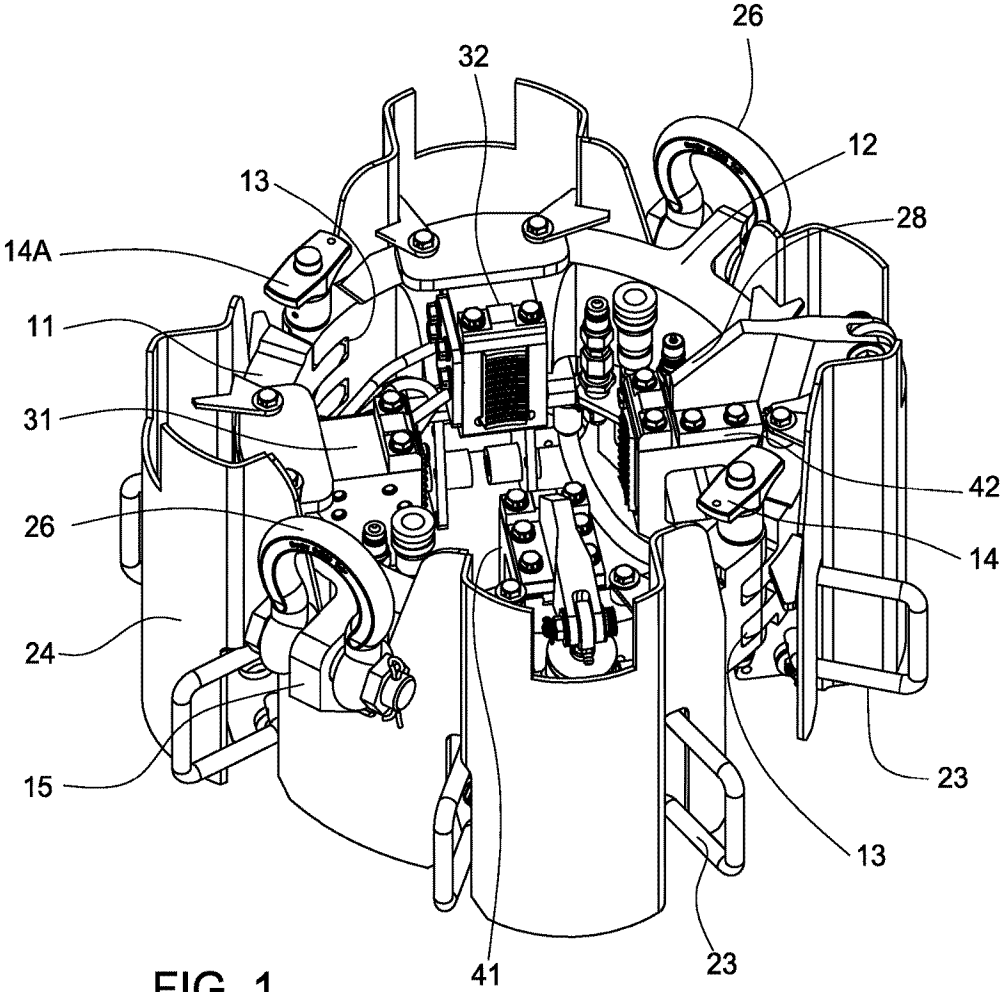
FIG. 1 is a perspective view of an embodiment of the elevator.
Figure 2D:
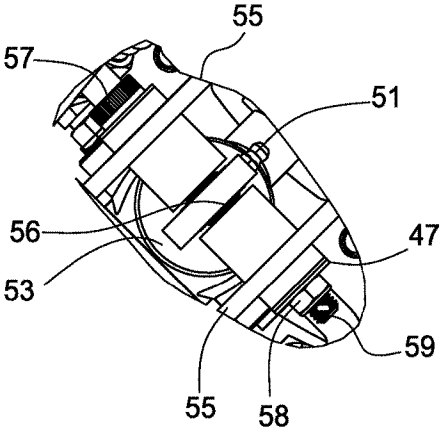
FIGS. 2A-2D are different views of the elevator of FIG. 1.
Figure 2A:
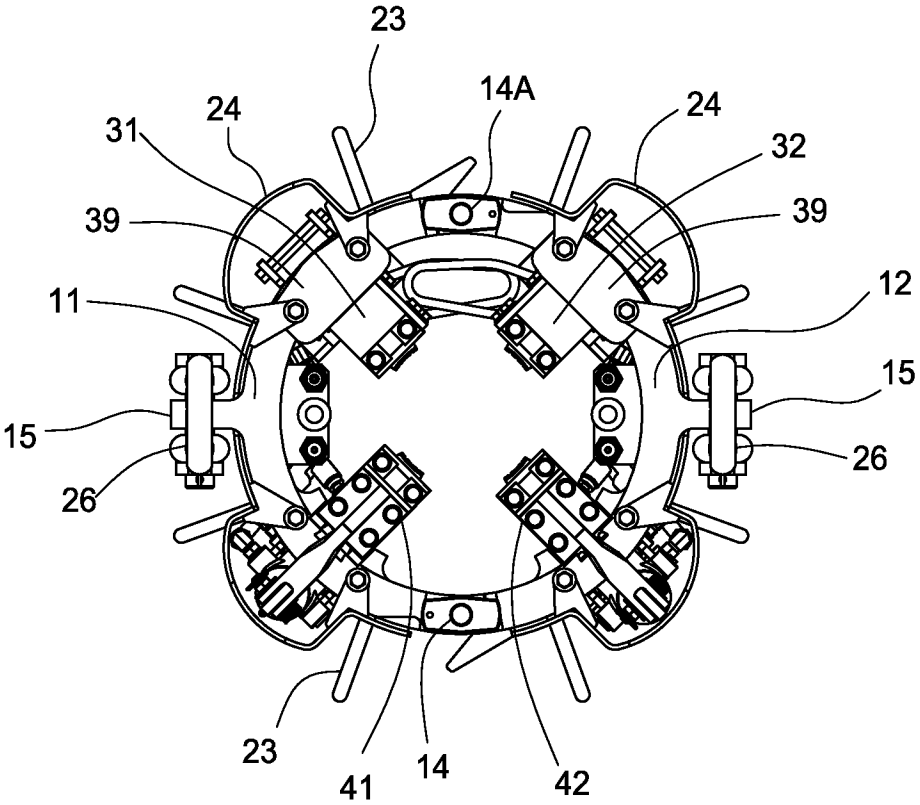
Figure 2C:
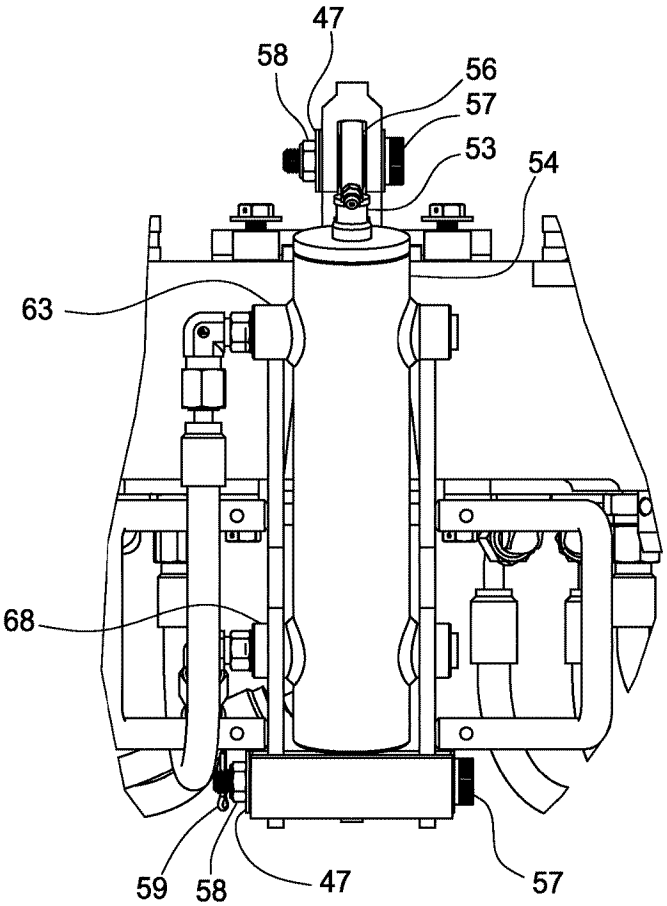
Figure 2B:
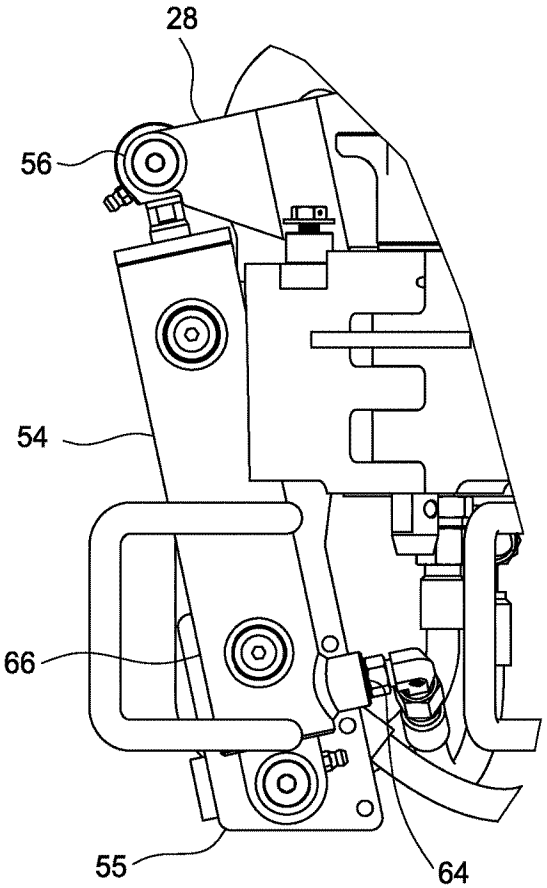

FIGS. 1 and 2A-2D illustrate an embodiment of an elevator 100 according to the present invention. FIG. 1 is a perspective view of the elevator 100. FIG. 2A is a top view of the elevator 100, and FIGS. 2B-2D are different, partial views of the elevator 100. The elevator 100 includes two arcuate body parts 11, 12 configured to close around a tubular. The two body parts 11, 12 may be coupled together using a pin 14 inserted through the hinges 13 of the body parts 11, 12. In this respect, the two body parts 11, 12 may be pivoted with respect to each other between an open position and a closed position. As shown, the other side of the two body parts 11, 12 is also coupled using a pin 14A. In this respect, the elevator 100 may be opened from either side of the elevator 100. It is contemplated that one side of the elevator 100 may be equipped with other suitable locking members such as a latch instead of the pin. The hinges 13 may be flush with the curvature of the body parts 11, 12 as shown, or may protrude from the body parts 11, 12 such that the pins 14, 14A are located further radially than the body parts 11, 12. Link ears 15 may be provided on each of the body parts 11, 12 for coupling to a link such as a bail or cable. As shown, the link ears 15 are integrated with the body parts 11, 12. In another embodiment, the link ears 15 are attached to the respective body parts 11, 12 at approximately the midpoint of the body parts 11, 12. Shackles 26 may be used to facilitate attachment to a cable or a link arm. In one embodiment, a guide may be mounted to a lower end of the elevator 100 to facilitate stabbing of the elevator 100 on to a vertically positioned tubular such as a pipe or casing. For example, the guide may be funnel shaped to direct the pipe or casing toward the opening in the elevator. The guide may be attached to the lower end of each gripping members 31, 32, 41, 42, although any suitable number such as two, three, five or more guides may be used. In another example, the guides may be attached to the lower end of the body parts 11, 12. A plurality of handles 23 are provided around the elevator 100 to facilitate handling of the elevator 100. One or more covers 24 are provided to protect the elevator 100 from damage.

The elevator 100 may be equipped with four gripping members 31, 32, 41, 42 configured to grip the tubular, as shown in FIG. 1 and FIG. 2A. An exemplary gripping member is a slip. The slips 31, 32, 41, 42 may be disposed around the interior of the elevator 100 in any suitable arrangement. In one embodiment, each body part 11, 12 may be equipped with two slips 31, 32, 41, 42. Each of the two slips 31, 32, 41, 42 on each body part 11, 12 may be passive or active. The passive slips 31, 32 may also be referred to herein as stationary slips. Preferably, each body part 11, 12 is equipped with one passive slip 31, 32 and one active slip 41, 42. It is contemplated that one, two, three, or all of the slips 31, 32, 41, 42 may be active or passive, for example, all active, or one active and three passive. In one arrangement, as shown in FIG. 1, the passive slips 31, 32 of each body parts 11, 12 are positioned on each side of one pin 14A, while the active slips 41, 42 are positioned on each side of the other pin 14. In another arrangement, one body part 11 is equipped with two passive slips 31, 32 and the other body part 12 is equipped with two active slips 41, 42.

Figure 3B:
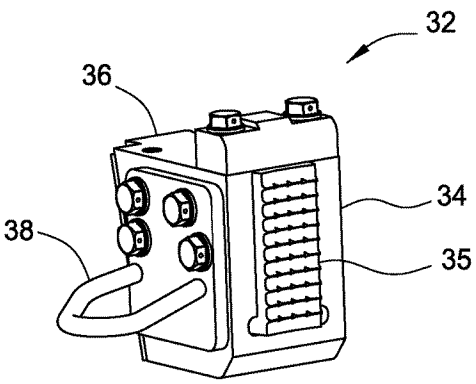
FIGS. 3A and 3B illustrate exemplary passive slips.
Figure 3D:
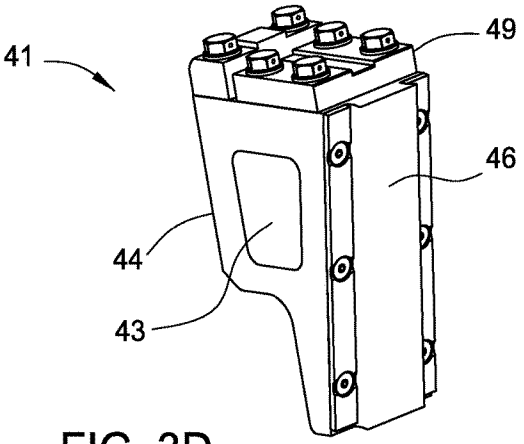
FIGS. 3C and 3D are different perspective views of an exemplary active slip.
Figure 3A:
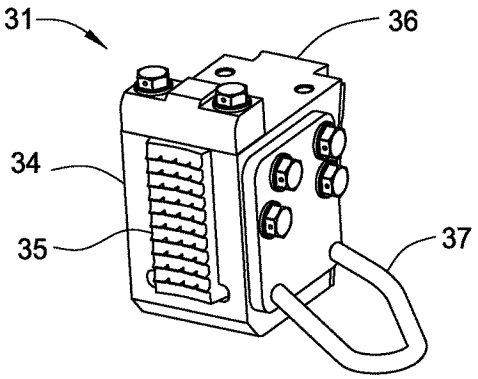

FIGS. 3A and 3B illustrate exemplary passive slips 31, 32 suitable for use with the elevator 100. As shown, each slip 31, 32 includes a slip body 34 and a gripping element 35 such as a die. The slip body 34 may be attached to the elevator body part 11, 12 in any suitable manner. In one embodiment, the backside of the slip body 34 may be coupled to the body part 11, 12 for axial movement. For example, the slip body 34 may include an engagement member 36 configured to engage a mating member on the body part 11, 12. In one example, the engagement member 36 and the mating member may be a dovetail and a complementary groove assembly. As shown, the dovetail is on the slip body 34 and the groove is on the body part 11, 12. In another example, the engagement member and the mating member may be a spline and groove connection. The top of the slip body 34 may be attached to a plate 39 (see FIG. 2A) extending from the body part 11, 12 to limit axial movement of the slip 31, 32. In another embodiment, the mating member forms an incline on which the passive slip 31, 32 may move between a gripping position and a released position. In this respect, when the tubular load is applied, the passive slips 31, 32 can move along the incline and apply a clamping force on the tubular. In another embodiment, an optional biasing member such as a spring may be used to maintain the passive slip 31, 32 in the released position until the tubular load is applied. For example, the biasing member may bias a lower end of the passive slips 31, 32 in an upward position. An optional absorbing element may be provided to the connection to the plate to act as a cushion.

In one embodiment, the passive slips 31, 32 may include a stabbing member 37, 38 extending from the side of the slip 31, 32. The stabbing members 37, 38 extend toward the adjacent passive slip 31, 32 and are configured to ensure that the tubular are gripped by the slips 31, 32, 41, 42 when the elevator 100 is closed. The stabbing member 37, 38 may be a rod, a blade, or any suitable device for centering the tubular. The stabbing member 37, 38 may be mounted or welded to the slips 31, 32. In another embodiment, the stabbing member 37, 38 may be mounted to a body part 11, 12 of the elevator 100.

Figure 3C:
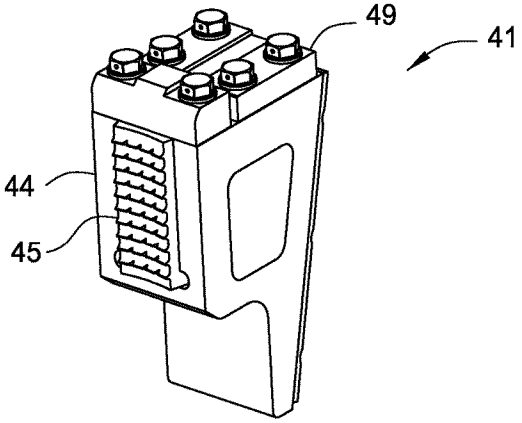
Figure 4:
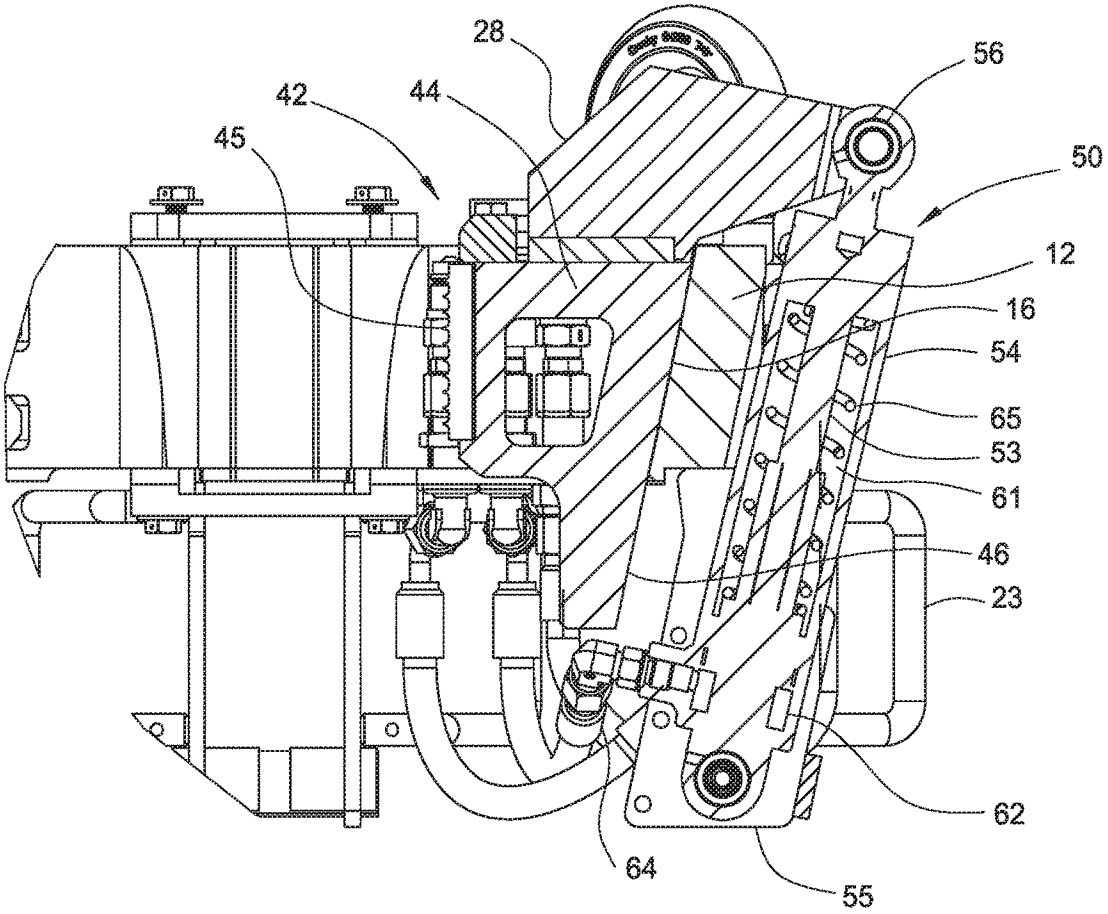
FIG. 4 illustrates an exemplary active slip.

Each body part 11, 12 may be equipped with an active slip 41, 42. FIGS. 3C, 3D, and 4 illustrate an exemplary active slip 41, 42 suitable for use with the elevator 100. FIGS. 3C and 3D are different perspective views of the active slip, and FIG. 4 is a partial cross-sectional view of the elevator 100. For sake of clarity, reference will only be made to one active slip 42. In this embodiment, the active slip 42 includes a slip body 44 and a gripping element 45 such as a die. The active slip 42 may include a hollow portion 43 to reduce the weight of the slip 42. The slip body 44 may be attached to the elevator body part 12 in any suitable manner. In one embodiment, the backside of the slip body 44 may be coupled to the body part 11, 12 for axial movement. For example, the slip body 44 may include an engagement member 46 configured to engage a mating member 16 on the body part 11, 12. In one example, the engagement member 46 and the mating member 16 may be a dovetail and a complementary groove assembly. As shown, the dovetail is on the slip body 44 and the groove is on the body part 11, 12. In another example, the engagement member and the mating member may be a spline and groove connection. The top of the slip body 44 may be attached to a connector arm 28 that is coupled to an actuator 50. The connector arm 28 allows the slip body 44 to be moved between an open position and closed position by the actuator 50. In one embodiment, the connector arm 28 may have a bend to provide more clearance above the body parts 11, 12. The connector arm 28 may be fixed to the slip body 44 using a screw, a weld, a dovetail connection, or other suitable attachment mechanisms. In one example, the connector arm 28 is coupled to the slip body 44 via a connector base 49. The connector base 49 may be attached to the slip body 44 using a screw or a weld, and may be coupled to the connector arm 28 using a dovetail connection.

In one embodiment, the engagement member 46 is configured with a length that is sufficiently long so that at least 25 percent of its length is engaged with the mating member 16 at all times, e.g., when in the closed position or the open position. For example, the engagement member 46 may be sufficiently long so that at least 33 percent, 40 percent, or 50 percent of its length is engaged with the mating member 16 at all times. In another example, the engagement member 46 may be sufficiently long so that the engagement member 46 is engaged with at least 40 percent, 50 percent, 60 percent, 70 percent, or 80 percent of the length of the mating member 16 at all times. The length of the engagement member 46 to the length of the mating member 16 may be in a ratio from 4:1 to 1:3. For example, the engagement member 46 may be twice as long as the length of the mating member 16. In another example, The length of the engagement member 46 to the mating member 16 may be in a ratio from 3:1 to 1:1.5, a ratio from 4:1 to 1.25:1, or a ratio from 4:1 to 1.5:1. In yet another example, the engagement member 46 is longer than the mating member 16, and the engagement member 46 is engaged with at least 40 percent, 60 percent, 80 percent, 90 percent, or the entire length of the mating member 16 at all times. In one example, the engagement member 46 is longer than the mating member 16, and the engagement member 46 is engaged with at least 90 percent of the length of the mating member 16 as the engagement member 46 moves between the open position and the closed position.

In one embodiment, the actuator 50 may be a piston and cylinder assembly 53, 54. Referring now to FIGS. 2B, 2C, 2D, and 4, the piston 53 is coupled to the connector arm 28, and the cylinder 54 is coupled to a bracket 55 attached to the body part 12. The piston 53 and the cylinder 54 are coupled to the connector arm 28 and the bracket 55, respectively, using a spherical bearing 56 to allow for relative pivotal movement of the piston 53 and the cylinder 54. Also, a screw 57 may be inserted through the bracket 55 and the spherical bearing 56 and threaded to a nut 58. In one embodiment, an optional pin 59 may be inserted through the bottom end of the screw 57 to prevent the screw 57 from detaching from the nut 58. The piston 53 and the connector arm 28 may be similarly connected using the screw 57 and nut 58. Optional washers 47 may be used with the coupling of the piston 53 and cylinder 54 to the elevator 100. An optional grease fitting 51 may be provided to supply grease to the spherical bearing 56. It is contemplated that other suitable types of connecting mechanism may be used, for example, a pin inserted through the bracket and the cylinder. In another embodiment, a mechanical linkage may be used to couple the active slips 41, 42 to provide uniform movement of the active slips 41, 42. An exemplary mechanical linkage is a levelling ring. If a mechanical linkage is used, it is contemplated that a single piston and cylinder assembly 53, 54 may be used to move both active slips 41, 42.

The cylinder 54 includes an upper chamber 61 and a lower chamber 62. The lower chamber 62 fluidly communicates with an "open" port 64, and the upper chamber 61 fluidly communicates with a "closed" port 63. As shown, the open and closed ports 63, 64 optionally extend from the exterior of the cylinder 54 to facilitate connection with the hydraulic lines. Depending on the operation, hydraulic fluid may be supplied or relieved through the open port 64 or the closed port 63. In one embodiment, the open port 64 may be disposed in a slot 66 of the bracket 55. A biasing member 65 such as a spring is provided in the upper chamber 61 to bias the piston 53 downward toward the closed position. In use, hydraulic fluid may be supplied through the open port 64 into the lower chamber 62 to urge the piston 53 upward, thereby lifting the slips 42 along the groove on the elevator 100. At the same, time, the spring 65 is compressed by upward movement of the piston 53. In one embodiment, a set signal port 68 may be provided to indicate the slips 42 are in the set position. For example, the set signal port 68 may send a set signal if the piston 53 has moved past the signal port 68, or if the set pressure is above a predetermined pressure threshold, or both. In this embodiment, the set signal port 68 is located above the open port 64. When the slip 42 is open, the seal separating the chambers 61, 62 is located above the set signal port 68. As a result, the set signal port 68 is exposed to the pressure from the open port 64. When the slip 42 is closed, the seal separating the chambers 61, 62 is located below the set signal port 68, thus blocking fluid communication from the open port 64 to the set signal port 68. As a result, the set signal port 68 is exposed to the pressure from the closed port 63, which signifies the slip 42 is closed. In another embodiment, a cam activated roller valve may be used to indicate the position of the slips 42.

In another embodiment, a counterbalance valve may be connected to the closed hydraulic line to prevent the slips 42 from opening inadvertently. The counterbalance valve is configured to prevent the closed hydraulic line from relieving pressure in the upper chamber 61 unless a predetermined condition exists. In one example, the counterbalance valve is a check valve and is in fluid communication with the open hydraulic line. The check valve will allow the closed hydraulic line to relieve pressure from the upper chamber 61 when the pressure in the open hydraulic line is at least one third of the pressure in the closed hydraulic line. It is contemplated that the open pressure condition may be any suitable pressure, such as at least 25% or at least 50% of the pressure in the closed hydraulic line, or the open pressure condition may be a predetermined pressure threshold.

Figure 5B:
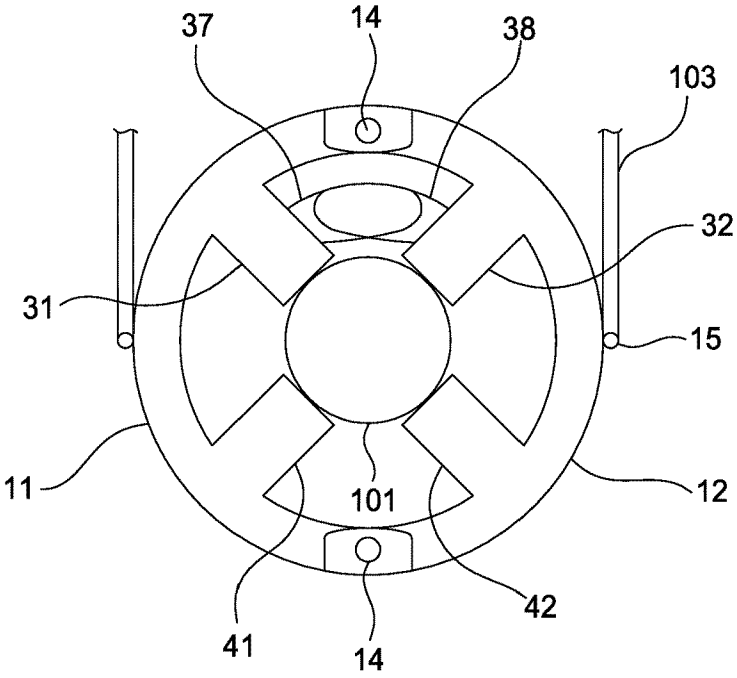
FIGS. 5A-5B show an embodiment of the elevator engaging a tubular in sequence.
Figure 5A:
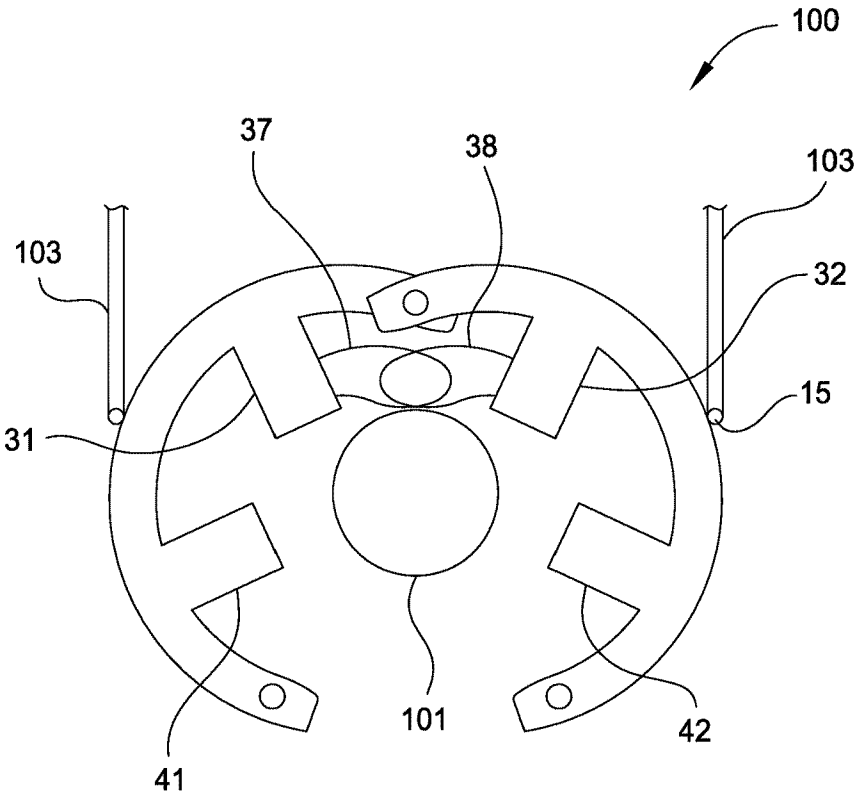

FIGS. 5A-5B schematically show an embodiment of the elevator 100 engaging a tubular 101 in sequence. In FIG. 5A, the elevator 100 is positioned to pick up a tubular 101 in a horizontal position. As shown, the elevator 100 is open, and the two passive slips 31, 32 are adjacent the top side of the tubular 101. The stabbing members 37, 38 of the elevator 100 are in contact with the tubular 101 and ensure the tubular 101 will be gripped by the slips 31, 32, 41, 42. To close the elevator 100, cables 103 coupled to the link ears 15 are lowered. In FIG. 5B, the elevator 100 is closed around the tubular 101 and the locking pin 14 is inserted through the hinges of the body parts 11, 12. Hydraulic fluid is supplied to the upper chamber 61 to actuate the active slips 41, 42 into engagement with the tubular 101. The hydraulic fluid urges downward movement of the piston 53 relative to the tubular 101. In turn, the active slips 41, 42 are moved along the inclined mating member, thereby urging the active slips 41, 42 radially inward into engagement with the tubular 101. During movement of the active slips 41, 42, the passive slips 31, 32 remain stationary relative to the body parts 11, 12. Movement of the active slips 41, 42 also moves the tubular 101 into gripping engagement with the passive slips 31, 32. After contacting the slips 31, 32, 41, 42, additional downward movement of the active slips 41, 42 will also cause the passive slips 31, 32 to move downward. The hydraulic fluid may be trapped in the upper chamber by a counterbalance valve to prevent the inadvertently release of the slips 41, 42. In this example, the valve will open when a predetermined condition is met, such as when the pressure in the open hydraulic line is at least 30% of the pressure of the closed hydraulic line. In yet another embodiment, if the set pressure exceeds 20 percent, the check valve will open to relieve pressure in the hydraulic line.

Although embodiments described herein references an elevator, it is contemplated the described features are equally applicable to a spider. For example, the spider may be provided with active slips having an engagement member that is sufficiently long so that at least 25% of its length is engaged with the mating member on the body of the spider. Also, the slips of the spider may be equipped with a stabbing member.

Figure 6B:
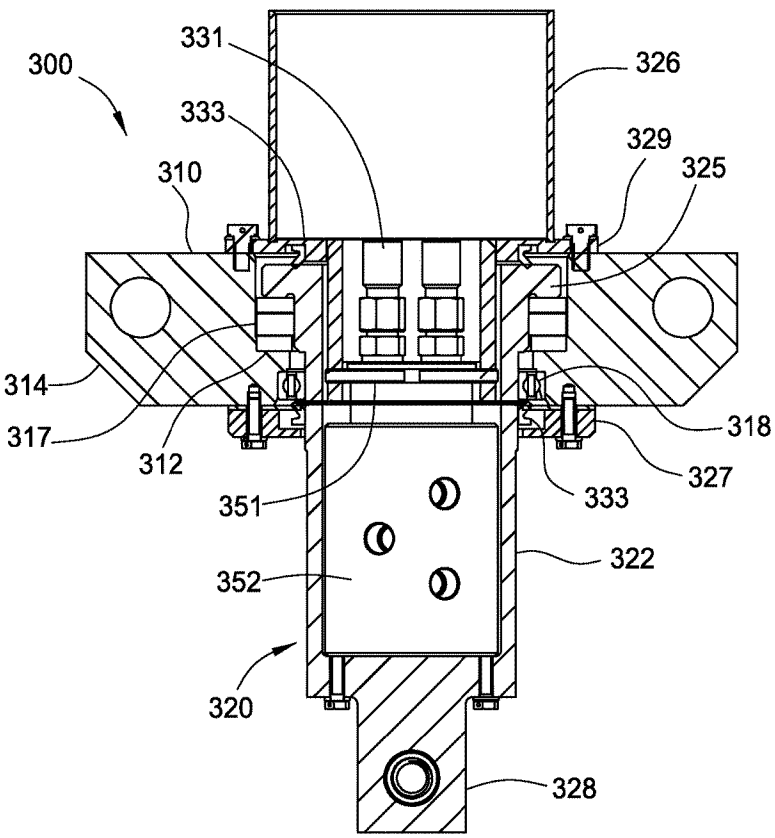
FIGS. 6A-6C illustrate an exemplary hydraulic swivel.
Figure 6A:
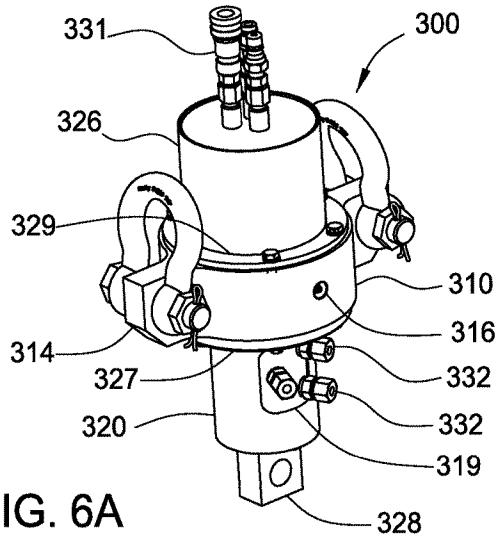
Figure 6C:
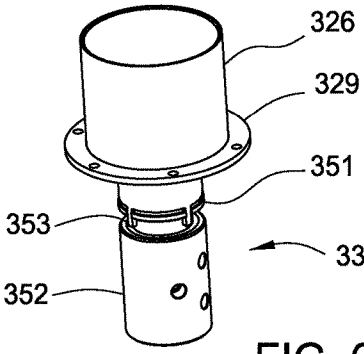

FIGS. 6A-6C illustrate an exemplary swivel 300 suitable for use with the elevator 100. FIG. 6A is a perspective view of the swivel 300, and FIG. 6B is a cross-sectional view of the swivel 300. FIG. 6C shows the tubular extension 326 coupled to the rotary union 300. In one embodiment, the swivel 300 may supply the hydraulic fluid or pneumatic fluid for operating the elevator 100. In another embodiment, the swivel 300 is configured to carry a load.

The swivel 300 includes an upper housing 310 rotatably coupled to a lower housing 320. The upper housing 310 and the lower housing 320 are configured to support a rotary union 330. The upper housing 310 includes a through bore and a shoulder 312 disposed on the inner surface of the bore. The upper housing 310 is provided with a lift member 314 for coupling with a cable or the travelling block of a rig. An exemplary lift member 314 is two lift ears attached to the upper housing 310, as shown in the Figures.

The lower housing 320 includes a tubular body 322 having a bore for receiving the rotary union 330. The outer diameter of the tubular body 322 is smaller than the inner diameter of the shoulder 312 in the bore of the upper housing 310. A flange 325 is provided at the top of the tubular body 322 and has an outer diameter larger than the inner diameter of the shoulder 312 in the bore of the upper housing 310. When coupled, the body 322 of the lower housing 320 may extend below the upper housing 310, and the flange 325 is disposed above the shoulder 312 of the bore. In one embodiment, the upper housing 310 and the lower housing 320 may be coupled by providing an axial bearing 317 between the flange 325 of the lower housing 320 and the shoulder 312 of the upper housing 310. In this respect, axial load experienced by the lower housing 320 may be transmitted from the lower housing 320 to the upper housing 310. In another embodiment, a radial bearing 318 may be used to couple the lower housing 320 to the upper housing 310 to facilitate rotation therebetween. A grease fitting 316 may be provided in the upper housing 310 to supply grease or other lubrication to the bearings 317. An optional bottom cover 327 may be attached to the bottom of the upper housing 310, and optional top cover 329 may be attached to the top of the upper housing 310. One or more seals 333, such as a viper seal, may be provided to allow grease to exit, but does not allow any substance to enter the swivel 300. An upper tubular extension 326 may be attached to the top of the upper housing 310 via the top cover 329. A connector 328 is provided at the lower end of the lower housing 320 to facilitate attachment to a cable, a link, or a tool. The connector 328 may have an arcuate shape or a rectangular shape as shown.

A rotary union 330 may be disposed in the lower housing 320 and the upper housing 310. The rotary union 330 may be any suitable rotary union 330 known to a person of ordinary skill in the art. For example, the rotary union 330 may include an upper body 351 rotatably coupled to a lower body 352. The upper body 351 includes one or more upper ports in fluid communication with one or more lower ports of the lower body 352. The upper port and the lower port are configured to remain in fluid communication while the lower body 352 is rotating relative to the upper body 351. In this embodiment, the upper ports include fittings 331 that extend above the upper housing 310, and the lower ports include fittings 332 that extend out of one or more openings 319 in the tubular body 322 of the lower housing 320. The lower ports and the lower body 352 are coupled to the lower housing 320 and movable therewith. The upper ports and the upper body 351 are coupled to the upper housing 310 and movable therewith. In one embodiment, the lower end of the extension tubular 326 includes teeth 353 for engaging slots in the upper body 351. In this respect, the upper body 351 moves with the extension tubular 326 and the upper housing 310. In FIG. 6A, the three upper ports are connected to a respective lower port using three different passages. The upper ports may be used to supply or withdraw hydraulic fluid or pneumatic fluid such as air. It is contemplated that the rotary union 330 may contain any suitable number of pairs of upper and lower ports, such as 1, 2, 4, 5, or more pair of ports.

In use, the upper housing 310 is attached to the travelling block via a cable connected to the lift ears 314. A tool such as an elevator 100 may be coupled to the lower housing 320. In one embodiment, an optional compensating cylinder may be provided between the elevator and the travelling block. During tubular makeup, the lower housing 320 allows the elevator to be rotated while the upper housing 310 and the travelling block remain stationary, e.g., non-rotating. It is contemplated the upper housing 310 and the travelling block may rotate slightly relative to the lower housing 320 while the lower housing 320 is rotating. Also, the swivel 300 can carry load and transmit the load to the travelling block during tubular make up.

Figure 7A:
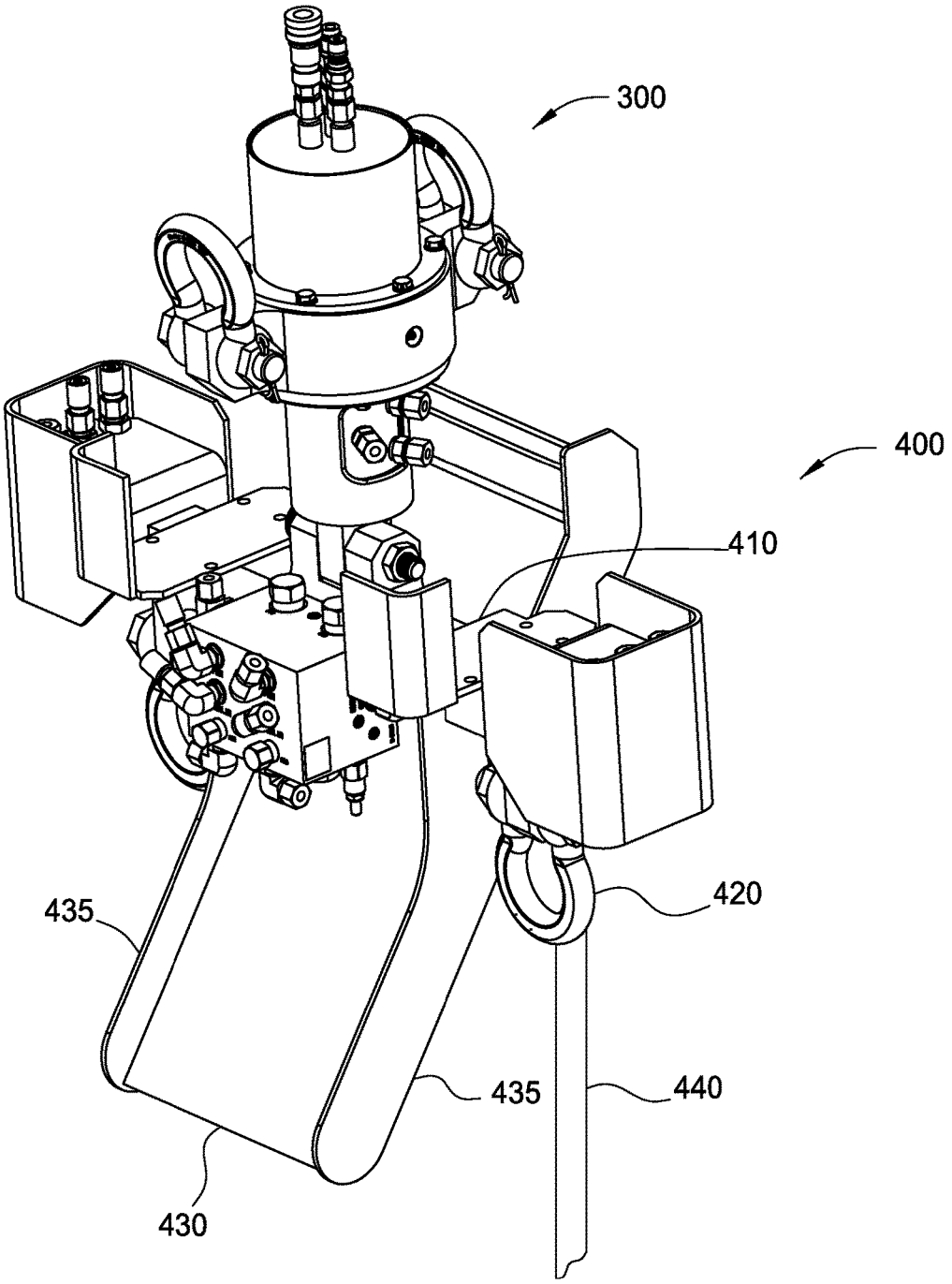
FIGS. 7A-7B are different views of an exemplary embodiment of a support frame attached to a swivel.
Figure 7B:
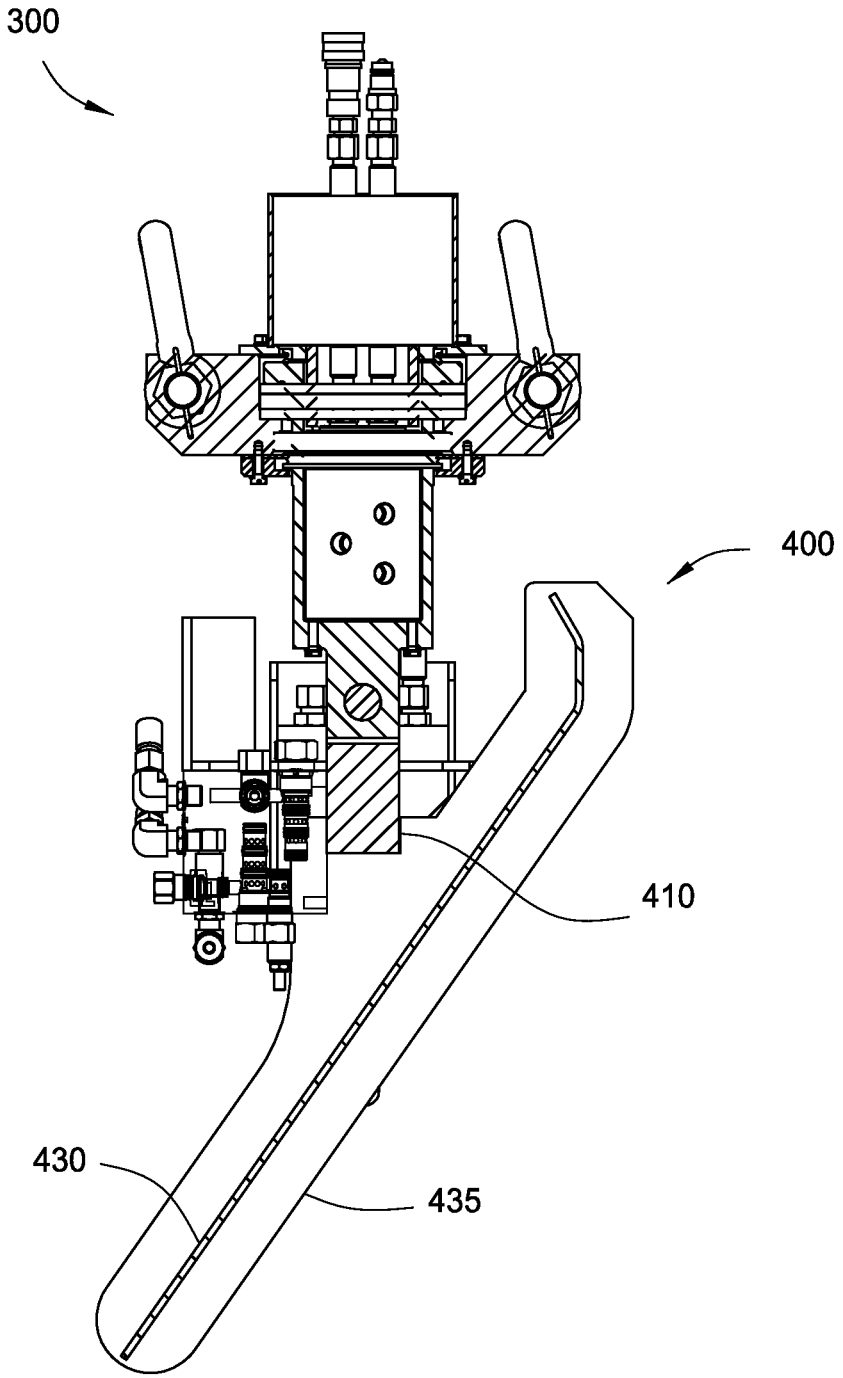

FIGS. 7A-7B illustrate an exemplary embodiment of a support frame 400 for coupling the elevator 100 to the swivel 300. FIG. 7B is a cross-sectional view of the support frame 400 of FIG. 7A. The support frame 400 includes a bar 410 pivotally attached to the lower housing 320 of the swivel 300. In this embodiment, the bar 410 is pivotally connected to the connector 328. Cables or other suitable links may be attached to a connector 420 such as a hinge or shackle on each side of the bar 410 for coupling the bar 410 to a tool such as the elevator. A plate 430 is attached below the bar 410 for deflecting the tubular supported by the elevator. In one embodiment, the plate 430 is position at an angle relative to the bar 410 to guide the deflection of the swivel 300 from the tubular. The plate 430 may be pivotally attached to the bar 410. In another embodiment, optional side walls 435 are attached to the plate 430. The side walls 435 extend below the plate 430 to keep the tubular between the side walls 435 of the plate 430.

Figure 8A:
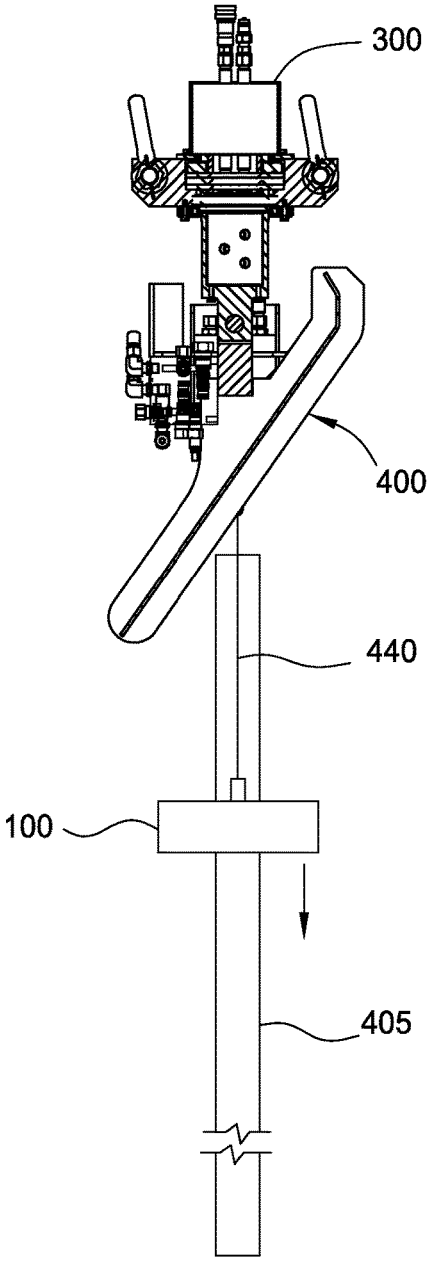
FIGS. 8A-8B illustrate the support frame of FIG. 7 in operation with an elevator and a swivel.
Figure 8B:
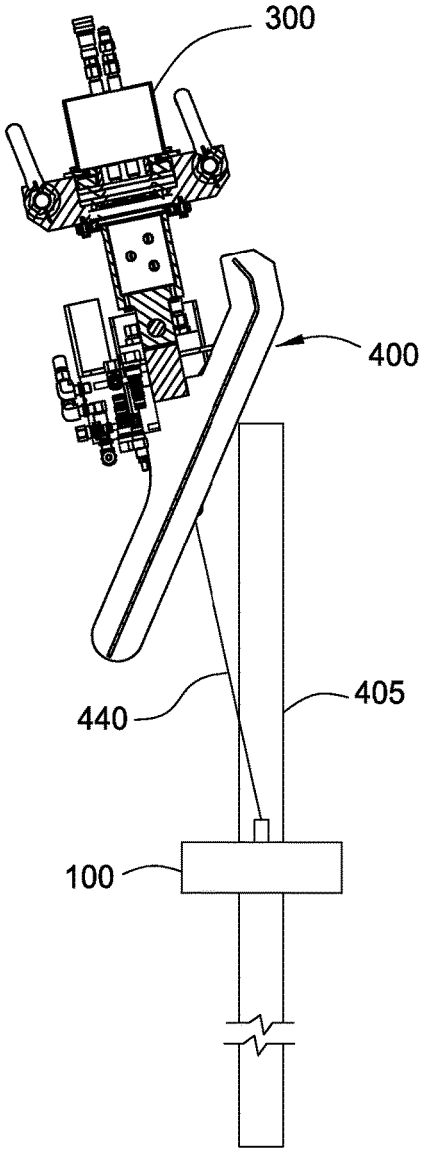

FIGS. 8A-8B illustrate the support frame 400 in operation with an elevator 100 and a swivel 300. As shown, the support frame 400 is pivotally attached to the swivel 300, and the elevator 100 is attached to the support frame 400 using cables 440. The tubular 405 (referred to as "joint" in this example) is retained by the elevator 100. Hydraulic lines may extend from the swivel 300 and along the cables on each side of the bar 410 down to the elevator 100 for operating the active slips 41, 42. After tubular 440 has been connected to another tubular, the elevator 100 is lowered so that it can be opened and removed from the tubular 440. In FIG. 8A, the elevator 100 is lowered relative to the tubular 440. As a result, the top of the tubular 440 will make contact with the bottom surface of the plate 430. As the elevator 100 is lowered further, the tubular 440 will slide along the bottom surface of the plate 430 as shown in FIG. 8B, thereby deflecting the swivel 300 away from the tubular 440. In this respect, the elevator 100 may be lowered relative to the tubular 440 without the swivel 300 colliding with the tubular 440. Although the support frame is shown with a swivel and an elevator, it is contemplated that the support frame may be used with other suitable tools to prevent a collision between the tubular and the tool above.

Figure 9A:
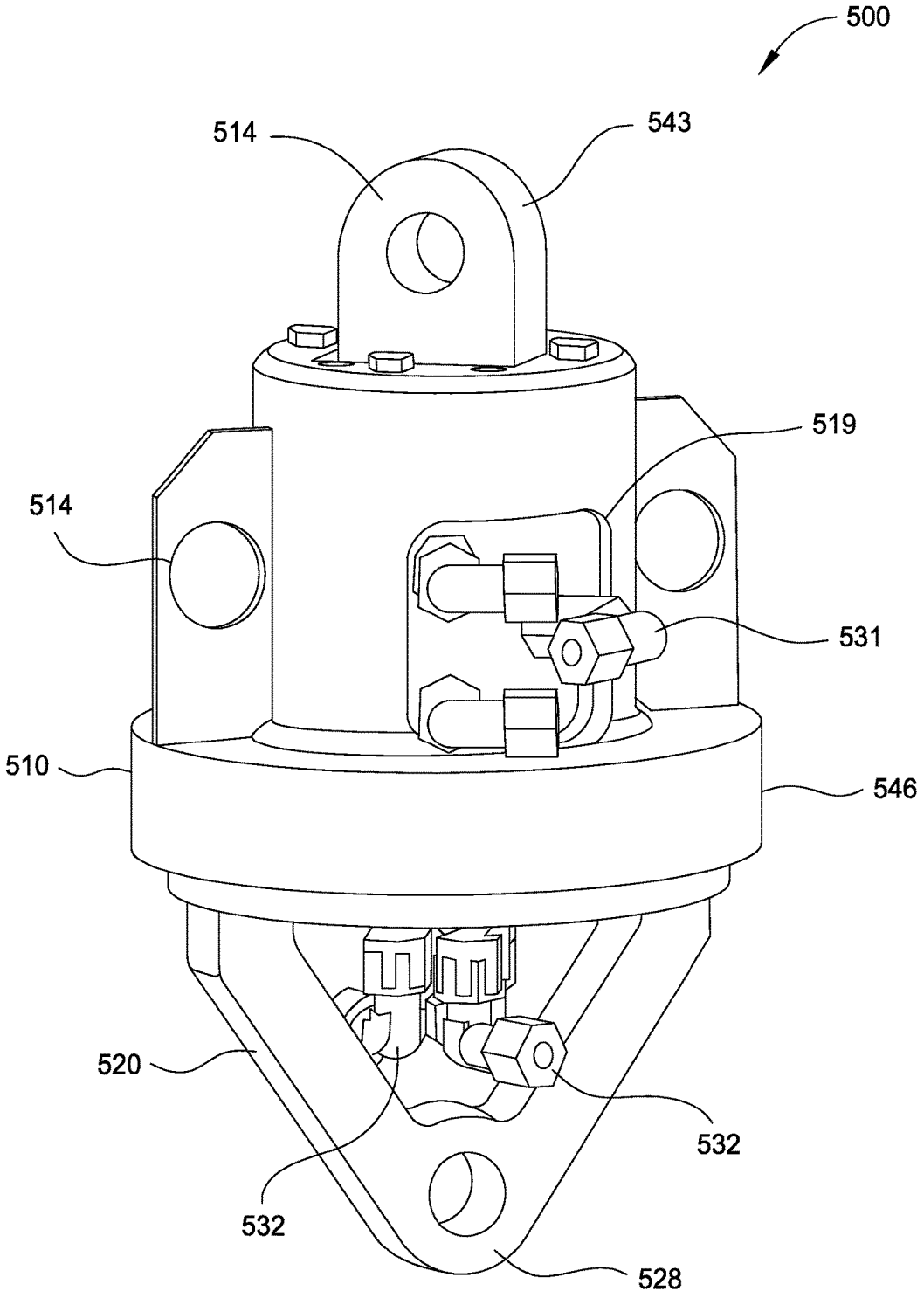
FIGS. 9A-9B illustrate another embodiment of a swivel.
Figure 9B:
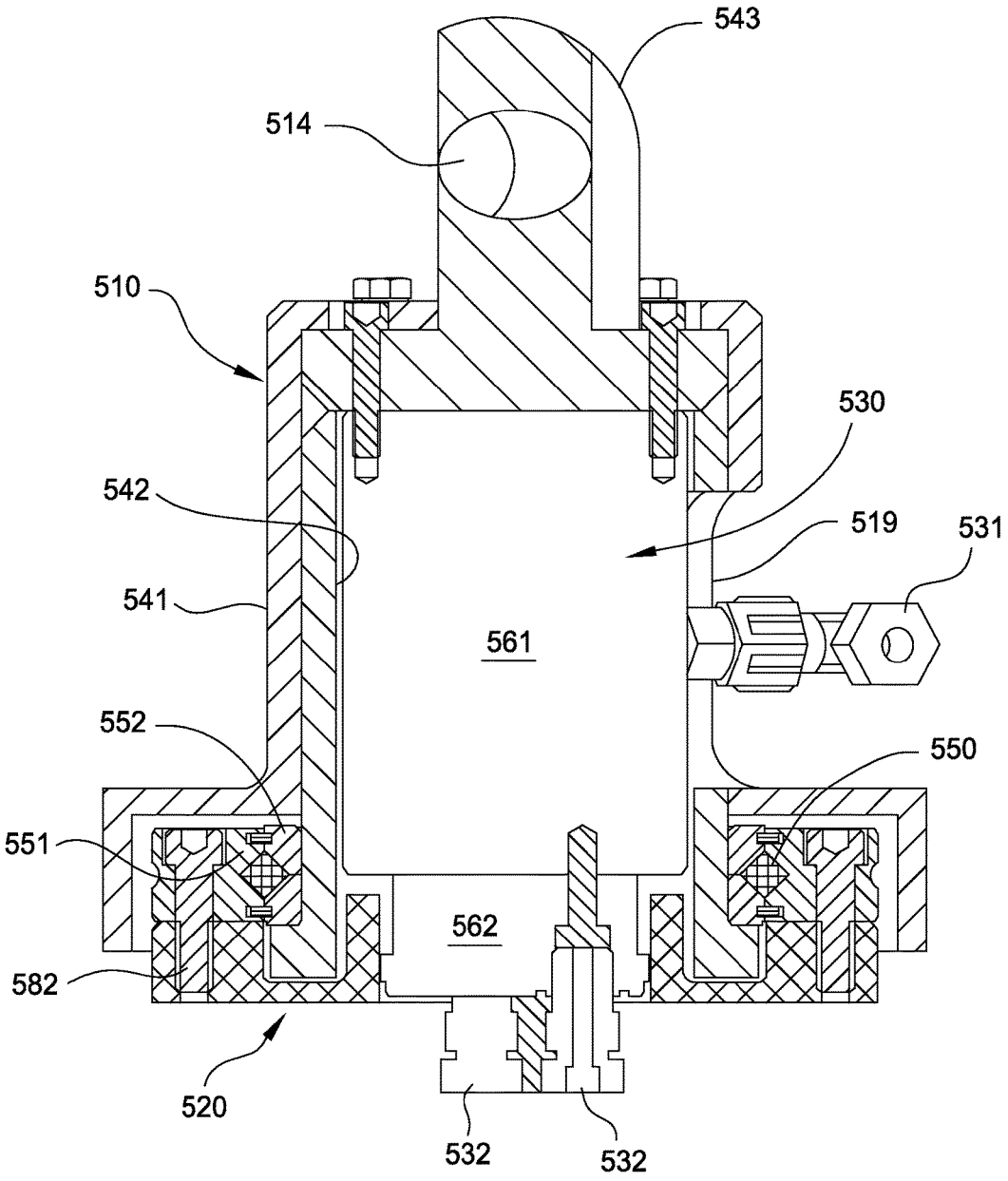

FIGS. 9A-9B illustrate another embodiment of a swivel 500. The swivel may be used to supply hydraulic fluid to a tool such as the elevator 100 in FIG. 1 for operating the active slips 41, 42. FIG. 9A is a perspective view of the swivel 500, and FIG. 9B is a partial cross-sectional view of the swivel 500. In one embodiment, the swivel 500 may supply the hydraulic fluid for operating the elevator 100. In another embodiment, the swivel 500 is configured to carry a load.

The swivel 500 includes an upper housing 510 rotatably coupled to a lower housing 520. The upper housing 510 and the lower housing 520 are configured to support a rotary union 530. The upper housing 510 includes an inner body 542 disposed in an outer body 541. A lift cap 543 is attached to the top of the inner body 542. In another embodiment, the lift cap 543 may be integral with the inner body 542. The lift cap 543 may be attached to the outer body 541 using screws or other suitable connection devices. The outer body 541 has a wider diameter base 546. The inner body 542 partially extends along the base 546, thereby forming an annular area for receiving a radial bearing 550. In one embodiment, the inner race 552 of the bearing 550 is attached to the inner body 542, and the outer race 551 is attached to the lower housing 520. A connector 528 is provided at the lower end of the lower housing 520 to facilitate attachment to a cable, a link, or a tool. The upper housing 510 may be provided with one or more lift members 514 for coupling with a cable or the travelling block of a rig. For example, a lift member 514 such as a loop may be provided on the lift cap 543. In another embodiment, optional lift members 514 such as loops or ears may be provided on the exterior of the outer body 541.

A rotary union 530 may be disposed in the upper housing 510 and the lower housing 520. The non-rotating upper body 561 of the rotary union 530 may be attached to the lift cap 543, and the rotating lower body 562 may be attached to the lower housing 520. The rotary union 530 may be any suitable rotary union known to a person of ordinary skill in the art. In one example, the upper body includes one or more upper ports 531 in fluid communication with one or more lower ports 532 of the lower body. The upper port 531 and the lower port 532 are configured to remain in fluid communication while the lower body is rotating relative to the upper body. In this embodiment, the upper ports 531 extend out of openings 519 in the upper housing 510, and the lower ports 532 extend below the lower housing 520. The lower ports 532 and the lower body 562 are coupled to the lower housing 520 and movable therewith. As shown, three upper ports 531 are connected to a respective lower port 532 using three different passages. The upper ports 531 may be used to supply or withdraw hydraulic fluid. It is contemplated that the rotary union 530 may contain any suitable number of pairs of upper and lower ports, such as 1, 2, 4, 5, or more pair of ports.

In use, the upper housing 510 is attached to the travelling block via a cable connected to the lift ears 314 or the loop. A tool such as an elevator may be attached below the lower housing 520. During tubular makeup, the lower housing 520 allows the elevator to be rotated while the upper housing 510 and the travelling block remain stationary. It is contemplated the upper housing 510 and the travelling block may rotate slightly relative to the lower housing 520 while the lower housing 520 is rotating. Also, the swivel 500 can carry load and transmit the load to the travelling block during tubular make up. The load may travel from the connector 528 to the lower housing 520, to the screws 582 connected to the outer race 551 of the radial bearing 550, to the inner race 552 of the radial bearing 550, to the inner body 542 of the upper housing 510, to lift cap 543, and then to the lift member 514.

In one embodiment, a tubular handling tool for handling a tubular includes a first body part coupled to a second body part; and at least two slips coupled to each of the first and second body parts, wherein one or more of the slips includes an engagement member for coupling with a mating member of the first body part or the second body part, wherein at least 25% of the engagement member is coupled with the mating member when the slip is in an open position.

In another embodiment, a tubular handling tool for handling a tubular includes a first body part coupled to a second body part; and a slip coupled to each of the first and second body parts, wherein at least one slip includes an engagement member for coupling with a mating member of the first body part or the second body part, wherein the engagement member is coupled with at least 40 percent of the mating member when the at least one slip is in the open position.

In one or more embodiments, one active slip and one passive slip are coupled to the first body part.

In one or more embodiments, one active slip and one passive slip are coupled to the second body part.

In one or more embodiments, the passive slips of the first and second body parts are positioned on each side of a hinge connection.

In one or more embodiments, two active slips or two passive slips are coupled to the second body part.

In one or more embodiments, the slip includes a biasing member for biasing the engagement member toward the open position.

In one or more embodiments, a ratio of a length of the engagement member to a length of the mating member is from 4:1 to 1:3.

In one or more embodiments, a ratio of a length of the engagement member to a length of the mating member is from 4:1 to 1.25:1.

In one or more embodiments, the engagement member is coupled with at least 40 percent of the mating member when the slip is in the open position.

In one or more embodiments, the engagement member is coupled with at least 80 percent of the mating member when the slip is in the open position.

In one or more embodiments, a stabbing member is coupled to at least one of the slips.

In one or more embodiments, the tubular handling tool is an elevator or a spider.

In another embodiment, an elevator for use in handling a tubular includes a first body part coupled to a second body part; a movable gripping member that is movable relative to the first body part; and a passive gripping member coupled to at least one of the first body part and the second body part.

In one or more embodiments, the elevator includes at least two movable gripping members.

In one or more embodiments, each of the first body part and the second body part includes at least one movable gripping member.

In one or more embodiments, each of the first body part and the second body part includes at least one passive gripping member.

In one or more embodiments, each of the first body part and the second body part includes at least one passive gripping member.

In one or more embodiments, the second body part includes two passive gripping members.

In one or more embodiments, the movable gripping member includes an engagement member for coupling with a mating member of the first body part or the second body part, and wherein at least 25% of the engagement member is coupled with the mating member when the movable gripping member is in an open position.

In one or more embodiments, the movable gripping member includes an engagement member for coupling with a mating member of the first body part or the second body part, and wherein the engagement member is coupled with at least 40 percent of the mating member when the movable gripping member is in the open position.

In one or more embodiments, the passive gripping member is movable in response to a tubular load.

In one or more embodiments, the movable gripping member comprises a slip.

In another embodiment, a swivel includes an upper housing rotatably coupled to a lower housing; and a rotary union having a rotating body attached to the lower housing and a non-rotating body attached to the upper housing, wherein the swivel is configured to transfer load from the lower housing to the upper housing.

In one or more embodiments, the swivel includes a radial bearing for coupling the lower housing to the upper housing.

In one or more embodiments, the swivel includes an axial bearing for coupling the lower housing to the upper housing.

In one or more embodiments, the swivel includes a support frame coupled to the lower housing.

In one or more embodiments, the swivel includes a deflection plate coupled to the support frame for deflecting the swivel away from a tubular.

In one or more embodiments, the deflection plate is positioned at an angle relative to a vertical axis.

In one or more embodiments, the support frame comprises a bar coupled to the lower housing, wherein the bar is configured to support a link.

In one or more embodiments, a cable is coupled to each side of the bar.

In one or more embodiments, the deflection plate includes side walls extending below the deflection plate.

In one or more embodiments, the rotary includes a passage for fluid communication between the rotating body and the non-rotating body.

The features and mechanisms of each embodiment may be interchangeable with the other embodiments described herein. Additionally, while the foregoing is directed to embodiments of the present invention, other and further embodiments of the invention may be devised without departing from the basic scope thereof, and the scope thereof is determined by the claims that follow.

The invention claimed is:

1. A tubular handling tool for handling a tubular, comprising:

a first body part coupled to a first end and a second end of a second body part;

a passive slip attached to each of the first and second body parts; and an active slip attached to each of the first and second body parts, wherein the active slip includes an engagement member for coupling with a mating member of the first body part or the second body part, wherein at least 80% of a length of the engagement member is coupled with the mating member when the active slip is in an open position and wherein a ratio of the length of the engagement member to a length of the mating member is from 4:1 to 1.25:1, and wherein the engagement member of the active slip is longer than an engagement member of the passive slip.

2. The tubular handling tool of claim 1, wherein the passive slips of the first and second body parts are positioned on each side of a hinge connection.

3. The tubular handling tool of claim 1, further comprising a biasing member for biasing the engagement member toward the open position.

4. The tubular handling tool of claim 1, wherein the passive slip is movable in response to a tubular load.

5. The tubular handling tool of claim 1, wherein the engagement member is coupled with at least 90% of the mating member when the slip is in the open position.

6. The tubular handling tool of claim 1, further comprising a stabbing member attached to each of the passive slips.

7. The tubular handling tool of claim 1, wherein the tubular handling tool is an elevator or a spider.

8. The tubular handling tool of claim 1, further comprising a piston and cylinder for moving the active slip.

9. The tubular handling tool of claim 8, wherein the active slips and the passive slips are disposed around an interior of the first body part and the second body part.

10. The tubular handling tool of claim 9, wherein the piston and cylinder assembly is disposed exterior of the first body part and the second body part.

11. The tubular handling tool of claim 10, further comprising a connector arm coupling the piston and cylinder assembly to the active slip.

12. The tubular handling tool of claim 11, wherein the connector arm extends across the first body part or the second body part.

13. The tubular handling tool of claim 12, wherein the connector arm is slidably attached to a top surface of the active slip.

14. The tubular handling tool of claim 12, further comprising a spherical bearing for coupling the piston and cylinder assembly to the connector arm.

15. The tubular handling tool of claim 1, wherein at least a portion of the engagement member extends below the mating member when the active slip is in a lower position relative to the mating member.

16. A tubular handling tool for handling a tubular, comprising:

a first body part coupled to a first end and a second end of a second body part;

a passive slip disposed in and attached to each of the first and second body parts;

an active slip disposed in and attached to each of the first and second body parts, wherein the active slip includes an engagement member for coupling with a mating member of the first body part or the second body part, wherein at least 80% of a length of the engagement member is coupled with the mating member when the active slip is in an open position and wherein a ratio of the length of the engagement member to a length of the mating member is from 4:1 to 1.25:1; and a piston and cylinder assembly for moving each of the active slips, wherein at least one of the first body part and the second body part is disposed radially between the piston and cylinder assembly and the respective active slip.

17. The tubular handling tool of claim 16, further comprising a connector arm coupling the piston and cylinder assembly to the active slip.

18. The tubular handling tool of claim 17, wherein the connector arm extends across at least one of the first body part and the second body part.

19. The tubular handling tool of claim 18, wherein the connector arm is slidably attached to a top surface of the active slip.

20. The tubular handling tool of claim 19, further comprising a spherical bearing for coupling the piston and cylinder assembly to the connector arm.

* * * * *